US006394872B1

(12) United States Patent
Watanabe et al.

(10) Patent No.: US 6,394,872 B1
(45) Date of Patent: May 28, 2002

(54) EMBODIED VOICE RESPONSIVE TOY

(75) Inventors: Tomio Watanabe, Soja; Hiroki Ogawa, Okayama, both of (JP)

(73) Assignee: Inter Robot Inc., Okayama (JP)

( * ) Notice: Subject to any disclaimer, the term of this patent is extended or adjusted under 35 U.S.C. 154(b) by 0 days.

(21) Appl. No.: 09/606,562

(22) Filed: Jun. 29, 2000

(30) Foreign Application Priority Data

Jun. 30, 1999 (JP) ..... 11-186898

(51) Int. Cl.[7] ..... A63H 30/00; A63H 3/28
(52) U.S. Cl. ..... 446/175; 446/297; 446/300
(58) Field of Search ..... 446/175, 297, 446/298, 299, 300, 301, 302, 303

(56) References Cited

U.S. PATENT DOCUMENTS 4,799,171 A * 1/1989 Cummings ..... 364/513.5
4,846,693 A * 7/1989 Baer ..... 434/608
4,850,930 A * 7/1989 Sato et al. ..... 446/175
4,913,676 A * 4/1990 Koguchi et al. ..... 446/300
4,923,428 A * 5/1990 Curran ..... 446/175
5,011,449 A * 4/1991 Handy et al. ..... 446/297
5,636,994 A * 6/1997 Tong ..... 434/308
5,746,602 A * 5/1998 Kikinis ..... 434/169
5,902,169 A * 5/1999 Yamakawa ..... 446/338
6,012,961 A * 1/2000 Sharpe, III et al. ..... 446/298
6,064,854 A * 5/2000 Peters et al. ..... 434/308
6,149,491 A * 11/2000 Arad et al. ..... 446/355

* cited by examiner

*Primary Examiner*—Jessica J. Harrison
*Assistant Examiner*—Alex F. R. P. Rada, II
(74) *Attorney, Agent, or Firm*—Koda & Androlia

(57) ABSTRACT

There is provided a robot or a picture on display, which is an embodied voice responsive toy for facilitating empathy. The toy is constructed by a voice input-output portion, a voice responsive pseudo-person, and a pseudo-person control portion, the voice input-output portion serves to input voice from the outside or output voice to the outside, and the pseudo-person control portion determines an action of the voice responsive pseudo-person from the voice passing through the voice input-output portion and actuates the voice responsive pseudo-person.

17 Claims, 5 Drawing Sheets

EMBODIED VOICE RESPONSIVE TOY

BACKGROUND OF THE INVENTION

1. Field of the Invention

The present invention relates to a toy used to enjoy conversation or an embodied voice responsive toy designed to facilitate mind communication through voice.

2. Prior Art

In recent years, toys moving their arms and legs or their heads in response to voice are popular. For example, "Interactive talking toy" disclosed in U.S. Pat. No. 4,923,428 can be cited. These execute a specific pattern motion or a combination of plurality motions in accordance with voice, and do not produce a motion pattern as a communication motion (motion for facilitating communication to a person or enhancing intimacy). However, they make a favorable impression on a youth living alone in a city apartment building or an apartment where to have a pet of an animal or the like is not permitted, especially on a lady, and at present, many such toys are sold.

Similarly, as a toy using voice, there is a message device which records and reproduces a voice. This toy reproduces a previously recorded talker's voice, with a motion of a robot, to facilitate mind communication. This solves a temporal distance by the voice. Such use of voice is also seen as message means in which a cassette tape recording a voice is exchanged, though it is not a toy. As compared with communication by only words, since an actual voice of a transmitter is transmitted, more smooth or intimate communication than a letter can be realized. This solves a spatial distance by voice.

The toy responding to voice has a significance as a tranquilizer for a person living alone, and the response of the toy is important. However, since such a conventional toy merely repeats a motion in proportion to the magnitude of amplitude by using the voice as a simple input, there has been a problem that it is difficult to empathize. Mind communication using voice is excellent in that both parties separated in distance or time are made not to feel distance or time and smooth or intimate communication is realized. However, in such mind communication means, a talker or listener must talk toward a robot thrashing its arms and legs, and there has been a defect that it is difficult to give his or her whole mind into voice. Then investigation has been made on means for facilitating empathy for a toy using voice, such as a toy used to enjoy conversation or a toy designed to facilitate mind communication through voice.

SUMMARY OF THE INVENTION

As a result of the investigation, there has been developed an embodied voice responsive toy which is constructed by a voice input-output portion, a voice responsive pseudo-person, and a pseudo-person control portion, the voice input-output portion serves to input voice from the outside or output voice to the outside, the pseudo-person control portion determines an action of the voice responsive pseudo-person from the voice passing through the voice input-output portion and to actuate the voice responsive pseudo-person. This embodied voice responsive toy may be constructed by adding a data input-output portion and a data conversion portion to the voice input-output portion, in which the data input-output portion serves to input data other than voice from the outside or output data other than voice to the outside, and the data conversion portion performs mutual conversion of the data other than the voice and the voice to transfer the voice to the voice input-output portion. The data input-output portion inputs and outputs data capable of synthesizing voice, which is input other than voice. Although the pseudo-person control portion determines the action of a robot from the voice, if the conversion of the data to a signal (sound) based on the voice can be made, it is not necessarily required to be able to recognize the meaning. The data conversion portion serves to perform the mutual conversion between such data and voice or sound. The voice or sound synthesized from the data is sent through the voice input-output portion to the pseudo-person control portion.

Although it is preferable that the voice responsive pseudo-person has a form imitating a human being, a personified animal or plant, other inorganic object, imaginary creature or object may be used. As described later, since the present invention produces an action to cause a human talker or listener to own the rhythm of conversation jointly, that is, a communication motion in accordance with ON/OFF of voice, as long as such action is performed, the pseudo-listener or pseudo-talker may be originally an inorganic vehicle or building, or other imaginary creature or object. Rather a deformed object, building or the like is preferable since it strengthens the side as an intimate toy. The listener control portion or talker control portion is constructed by a computer. As to a robot, a driving circuit is connected to a computer (or a dedicated processing chip, etc.) and control and driving is made. The computer constructs the voice input-output portion, the data input-output portion, and the data conversion portion in hardware or software, and it is also easy to change control specification.

Specifically, (1) the voice responsive pseudo-person is a listener robot, the pseudo-person control portion is a listener control portion, the listener robot makes an action of nodding of a head, opening and closing of a mouth, blinking of an eye, or gesturing of a body in response to the voice, and the listener control portion determines the action of the listener robot on the basis of the voice passing through the voice input-output portion and activates the listener robot.

Besides, (2) the voice responsive pseudo-person is a talker robot, the pseudo-person control portion is a talker control portion, the talker robot makes head motion, opening and closing of a mouth, blinking of an eye, or gesturing of a body in response to the voice, and the talker control portion determines the action of the talker robot on the basis of the voice passing through the voice input-output portion and activates the talker robot.

Further, (3) the voice responsive pseudo-person is a shared robot of a listener and a talker, the pseudo-person control portion is listener and talker control portions, the shared robot makes an action of nodding of a head, head motion, opening and closing of a mouth, blinking of an eye, or gesturing of a body in response to the voice, the listener control portion determines the action of the shared robot as a listener on the basis of the voice passing through the voice input-output portion and activates the shared robot, and the talker control portion determines the action of the shared robot as a talker on the basis of the voice passing through the voice input-output portion and activates the shared robot.

Even if a pseudo-listener or a pseudo-talker is displayed on a display portion by an animation or the like instead of a robot, the basic operation and effect of the present invention are not changed. As the pseudo-listener or pseudo-talker displayed on the display portion, a synthesized picture responding by using a real picture, CG (Computer Graphic) newly forming a picture or an animation can be used. In the case where a computer is used for the listener control portion or the talker control portion, the computer synthesizes the synthesized picture, CG or animation, and displays the motion picture on the display portion of the computer.

In the case where the foregoing display portion is used, specifically, (4) the voice responsive pseudo-person is a listener display portion displaying a listener, the pseudo-person control portion is a listener control portion, the listener display portion displays a pseudo-listener, which makes an action of nodding of a head, opening and closing of a mouth, blinking of an eye, or gesturing of a body in response to the voice, on the listener display portion, and the listener control portion determines the action of the pseudo-listener on the basis of the voice passing through the voice input-output portion and moves the pseudo-listener displayed on the listener display portion.

Alternatively, (5) the voice responsive pseudo-person is a talker display portion displaying a talker, the pseudo-person control portion is a talker control portion, the talker display portion displays a pseudo-talker, which makes head motion, opening and closing of a mouth, blinking of an eye, or gesturing of a body in response to a voice signal, on the talker display portion, the talker control portion determines the action of the pseudo-talker on the basis of the voice passing through the voice input-output portion and moves the pseudo-talker displayed on the talker display portion.

Alternatively, (6) the voice responsive pseudo-person is a shared display portion displaying a listener and a talker, the pseudo-person control portion is listener and talker control portions, the shared display portion displays a pseudo-talker and a pseudo-listener individually, which make an action of nodding of a head, head motion, opening and closing of a mouth, blinking of an eye, or gesturing of a body in response to a voice signal, in the same space, the listener control portion determines the action of the pseudo-listener on the basis of the voice passing through the voice input-output portion and moves the pseudo-listener displayed on the shared display portion, and the talker control portion determines the action of the pseudo-talker on the basis of the voice passing through the voice input-output portion and moves the pseudo-talker displayed on the shared display portion.

In the case where the present invention is utilized as a toy used to enjoy conversation, voices are directly exchanged through a microphone or speaker from the voice input-output portion. In the case where it is used as a toy designed to facilitate mind communication, a voice is recorded on a recording medium by a separately provided voice recording or reproducing portion and is sent to the other party, and is reproduced. In the case where data is made the base, the data can be recorded in a data recording or reproducing portion, or can be reproduced. Although the recording medium may be constructed integrally with the voice input-output portion or data input-output portion, when an external storage device is additionally used as the recording medium, longer voice or data can be processed. As the external storage device, various magnetic tapes (including a cassette tape), magnetic disks, magneto-optical disks, or various media using memories can be used. Although most of the external storage devices can erase recorded contents and can be again used, in the case where it does not matter if mind communication is only performed once, a CD-ROM, CD-R, DVD-ROM or record can also be used.

Important actions of the voice responsive pseudo-person are different according to whether the voice responsive pseudo-person is a talker or a listener. (a) The action (communication motion) of the voice responsive pseudo-person as the listener is made of a selective combination of nodding of a head, blinking of an eye, and gesturing of a body. The nodding is executed at a nodding timing when the prediction value of nodding presumed from ON/OFF of the voice exceeds a nodding threshold, the blinking is executed at a blinking timing which is exponentially distributed with the passage of time from the nodding timing as a starting point, and the gesturing of the body is executed at a gesturing timing when the prediction value of nodding presumed from ON/OFF of the voice exceeds a gesturing threshold.

Besides, (b) the action (communication motion) of the voice responsive pseudo-person as a talker is made of a selective combination of head motion, opening and closing of a mouth, blinking of an eye, and gesturing of a body. The head motion is executed at a head motion timing when the prediction value of head motion presumed from ON/OFF of the voice exceeds the threshold of head motion, the blinking is executed at a blinking timing when the prediction value of blinking presumed from ON/OFF of the voice exceeds a blinking threshold, and the gesturing of the body is executed at a gesturing timing when the prediction value of head motion or the prediction value of gesturing presumed from ON/OFF of the voice exceeds a gesturing threshold.

The action (communication motion) determined in this manner produces the rhythm of conversation between the pseudo-listener and the talker (or pseudo-talker and listener), and causes embodied entrainment (also called merely entrainment). This entrainment produces an atmosphere where a person can talk or listen with ease, and causes empathy with the pseudo-listener or pseudo-talker played by the robot, the animation on the display portion, or the like.

The combination of the actions is free. For example, the pseudo-talker uses the head motion instead of the nodding, and the pseudo-listener does not use basically the opening and closing of the mouth. With respect to the gesturing of the body, in the algorithm to obtain the nodding timing, the gesturing threshold with a value lower than the nodding threshold is used to obtain the gesturing timing. In the gesturing, movable portions are moved in accordance with the change of the voice, the movable portions of the body are selected in response to the voice, or a predetermined motion pattern (combination of the movable portions and the motion amounts of the respective portions) is selected. The selection of the movable portions or motion patterns in the gesturing makes the cooperation of the nodding and the gesturing natural. Like this, in the present invention, except for the opening and closing of the mouth and the motions of the respective portions of the body on the basis of the amplitude of the voice, the communication motion is realized mainly through the nodding timing in the pseudo-listener and mainly through the head motion in the pseudo-talker.

The important nodding timing is determined by algorithm to compare the nodding threshold, which is obtained from a prediction model obtained by combining the voice to the nodding linearly or nonlinearly, for example, aMA (Moving-Average Model) or neutral network model, with the predetermined nodding threshold. In the present invention, in the case of the pseudo-listener, the prediction model relating the voice to the nodding is used, and in the case of the pseudo-talker, the prediction model relating the voice to the head motion is used. In this algorithm, the voice is grasped as ON/OFF of an electric signal with the passage of time, the prediction value of nodding (in the case of the talker, prediction value of head motion) obtained from the ON/OFF of the electric signal with the passage of time is compared with the nodding threshold (in the case of the talker, threshold of head motion) or the gesturing threshold, and the nodding timing or the gesturing timing is derived. Since the simple ON/OFF of the electric signal is made the basis, a calculation amount is small, and even if a CPU with low performance is used for determination of real-time actions, promptness is not lost. The present invention is characterized in that the entrainment is caused from ON/OFF when the voice is regarded as an electric signal. Further, in addition to the ON/OFF, the cadence or intonation indicating the change of the electric signal with the passage of time may also be taken into consideration together.

DETAILED DESCRIPTION OF THE INVENTION

Figure 1:
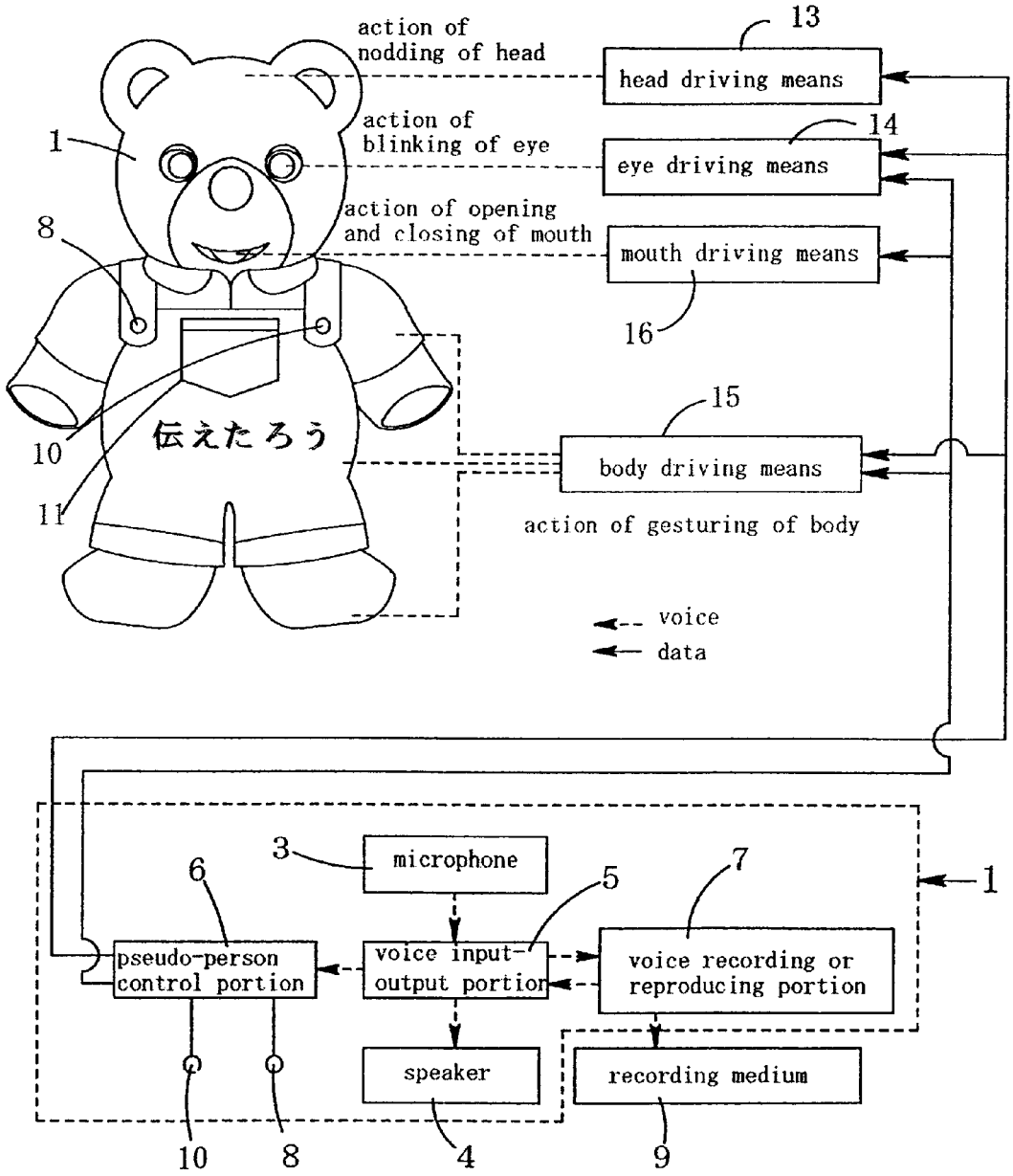
FIG. 1 is a structural view of an embodied voice responsive toy (model name "Tutae-Taro" ("Tutae" is Sending a message, "Taro" is a boy's name in Japan)) imitating a stuffed bear.
Figure 4:
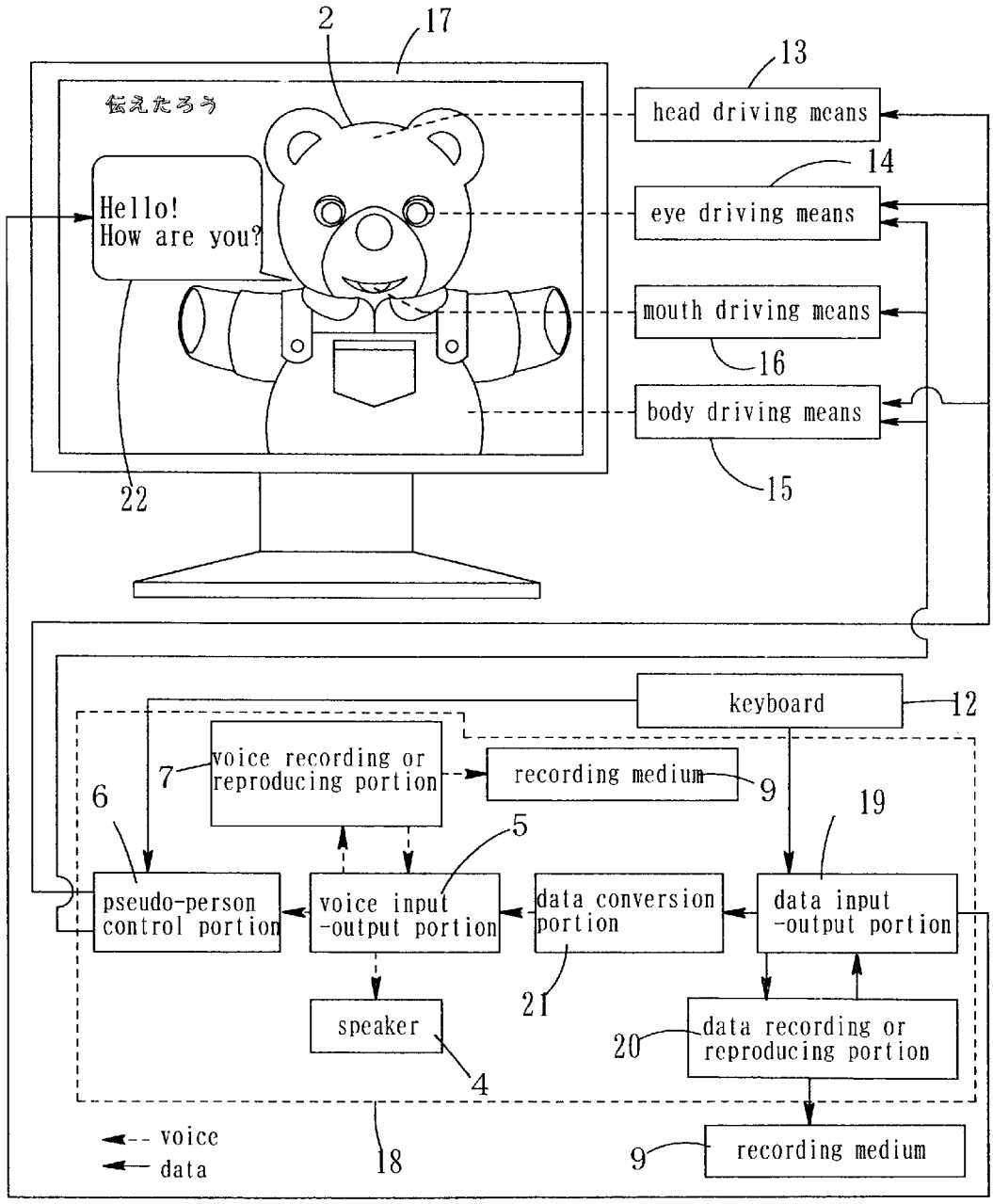
FIG. 4 is a structural view of an embodied voice responsive toy (model name "Tutae-Taro") using an animation of a bear.

FIG. 1 and FIG. 4 show structures using a stuffed toy 1 and an animation 2, serving as both a pseudo-listener and a pseudo-talker, respectively. A structure of only a pseudo-listener or pseudo-talker may be adopted.

In the example of FIG. 1, a microphone 3, a speaker 4, a voice input-output portion 5, a pseudo-person control portion 6, and a voice recording or reproducing portion 7 are housed in a stuffed bear 1. In the case where the stuffed toy 1 operates as a pseudo-listener, a listener switch 8 is pressed so that the pseudo-person control portion 6 is made a listener control portion, voice collected from the microphone 3 is sent from the voice input-output portion 5 to the pseudo-person control portion 6, and the stuffed toy 1 is made to operate as the pseudo-listener. The voice is sent to the voice recording or reproducing portion 7 at the same time, and can be recorded on a recording medium 9. In the case where the stuffed toy 1 operates as a pseudo-talker, a talker switch 10 is pressed, so that the pseudo-person control portion 6 is made a talker control portion, the voice obtained by reproducing the recording medium 9 by the voice recording or reproducing portion 7 is sent from the voice input-output portion 5 to the pseudo-person control portion 6, and the stuffed toy 1 is made to operate as the pseudo-talker. The voice is sent from the voice input-output portion 5 to the speaker 4 at the same time, and is sent to the outside. In the case where mind communication is attempted, the stuffed toy 1 itself, together with the recording medium 9, is exchanged, or both persons attempting the mind communication own the same toys of the invention and only the recording medium 9 is exchanged. In this example, although the stuffed toy 1 serves as both the pseudo-listener and the pseudo-talker, in the case of a toy having only one of them, on the assumption that a transmitter has a pseudo-listener and a destination has a pseudo-talker, only the recording medium 9 is exchanged.

For example, the voice input-output portion 5 and the voice recording or reproducing portion 7 can be constructed by a cassette tape recorder, and the pseudo-person control portion 6 can be constructed by a microcomputer, in which they are integrated with each other. The positions of the respective embedded portions in the stuffed toy 1 are free. In this example, a left button of overall type clothes is made the listener switch 8, and a right button is made the talker switch 10. The microphone 3 and the speaker 4 are embedded in the head portion, a tape insertion port 11 of a cassette tape recorder is allocated to a breast pocket of the overall, and the cassette recorder constituting the voice input-output portion 5 and the voice recording or reproducing portion 7, and the microcomputer constituting the pseudo-person control portion 6 are housed in the body portion (in a square broken line in FIG. 1). Each portion is an electrical or electronic equipment, and a power source is supplied from a built-in battery or through an AC adapter (not shown).

Figure 2:
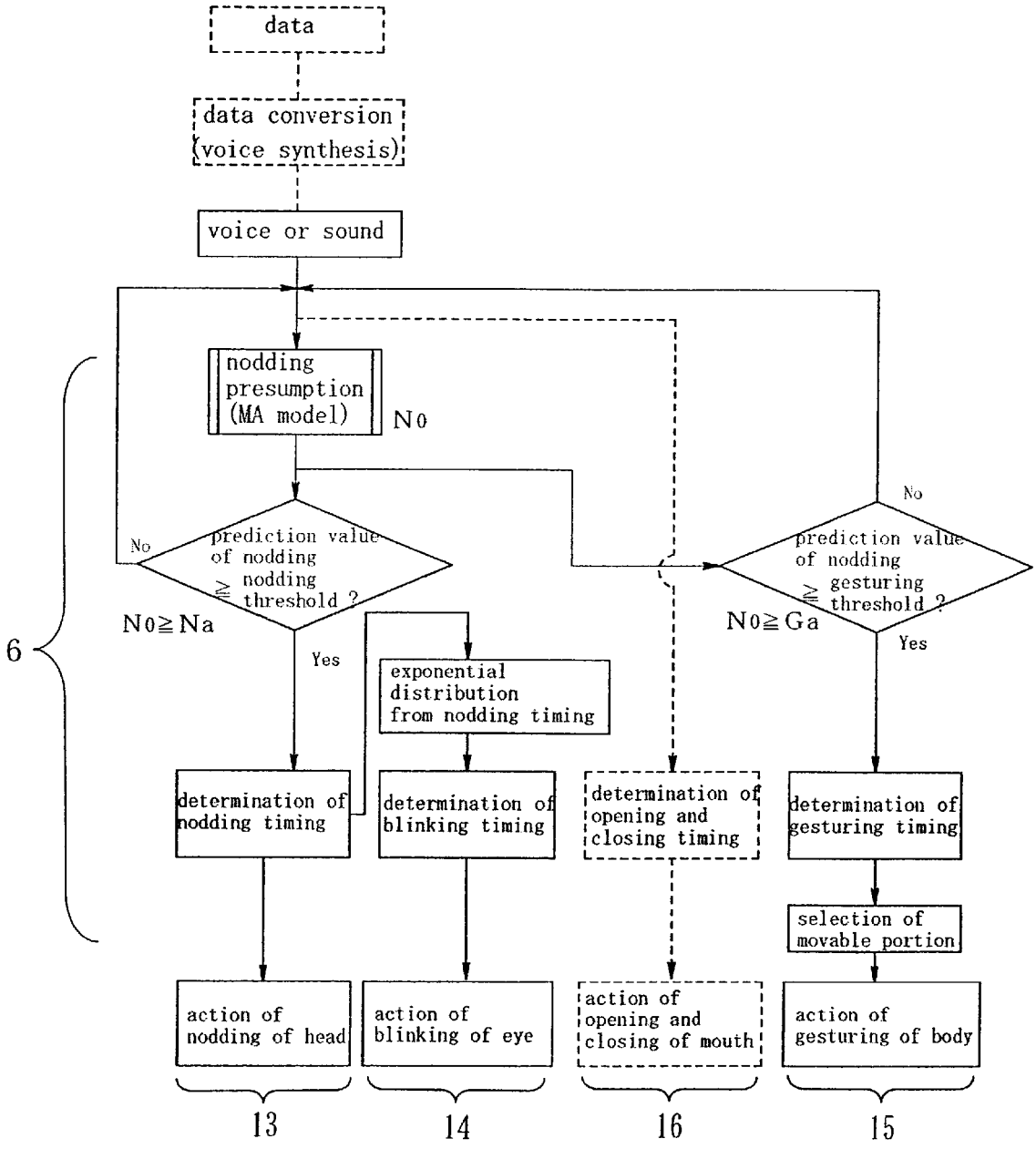
FIG. 2 is a flow sheet at the time of listener control in the toy.

In the case where the stuffed toy 1 is made to operate as a pseudo-listener, in the state where the listener switch 8 is pressed, the voice of a user talking to the stuffed toy 1 is collected by the microphone 3, is taken in through the voice input-output portion 5, and is recorded on a cassette tape (recording medium) by the voice recording or reproducing portion 7. At the same time, the voice is transmitted from the voice input-output portion 5 to the pseudo-person control portion 6 operating as the listener control portion. In accordance with a pseudo-listener control flow shown in FIG. 2, head driving means 13, eye driving means 14 and body driving means 15 are respectively selectively actuated, so that the stuffed toy 1 suitably performs nodding, blinking, or gesturing. As the gesturing, there are tilting or rotating of a head except for nodding, swinging or bending of an arm, bending or rotating of a body, and swinging or bending of a leg. Since opening and closing of a mouth is unnatural for the pseudo-listener, the opening and closing of the month is not performed. However, the opening and closing of the mouth may also be performed. As the head driving means 13, the eye driving means 14, and the body driving means 15, a motor, a solenoid, a cylinder, a shape memory alloy, or an electromagnet can be used, or crank movement or gear movement can be used.

Figure 3:
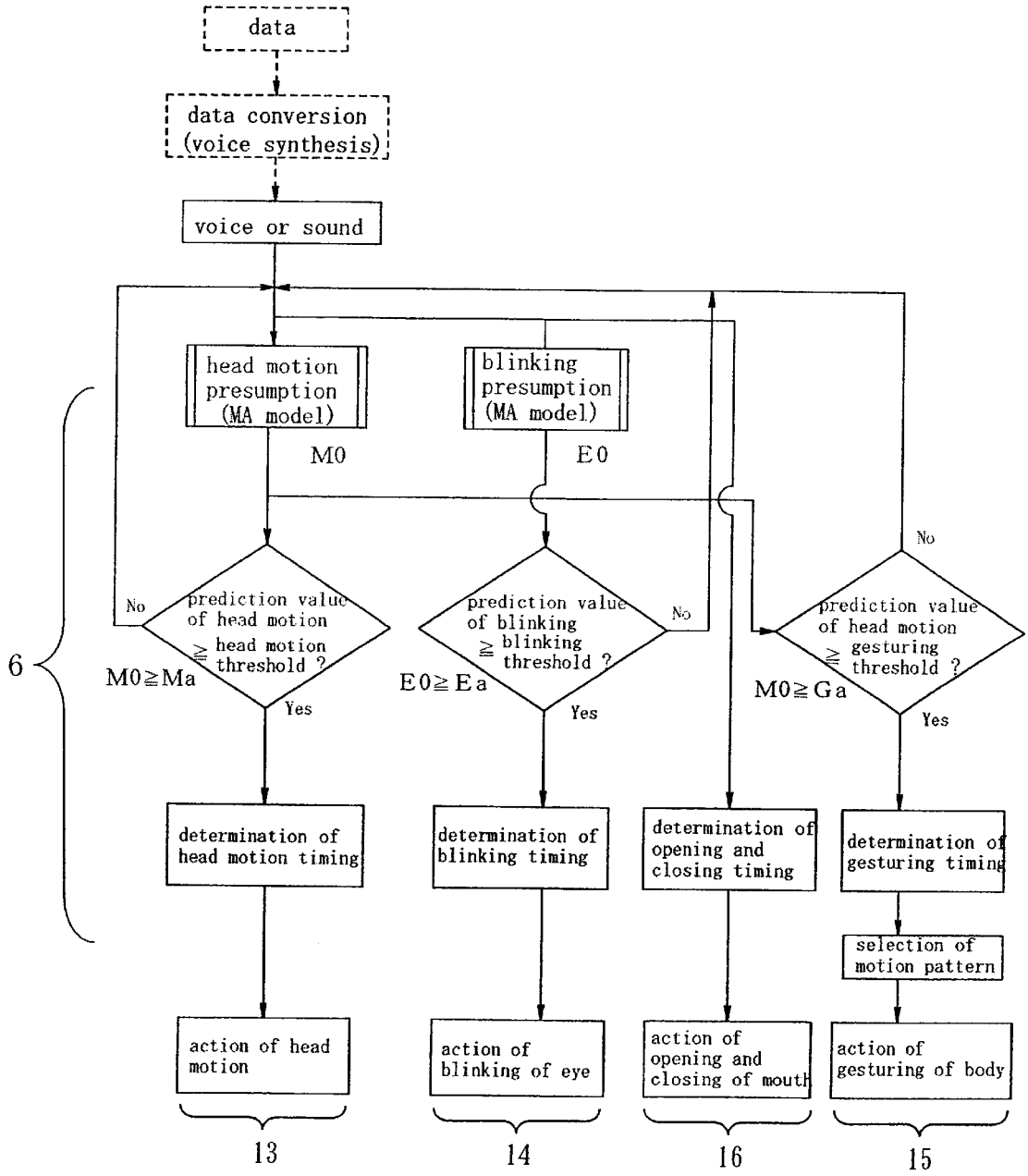
FIG. 3 is a flow sheet at the time of talker control in the toy.

In the case where the stuffed toy 1 is made to operate as a pseudo-talker, the cassettetape (recording medium) 9 recording voice is reproduced by the voice recording or reproducing portion 7, and the voice is sent from the speaker 4 through the voice input-output portion 5. In addition, the voice is transmitted to the pseudo-person control portion 6 as the talker control portion from the voice input-output portion 5. In accordance with a pseudo-talker control flow shown in FIG. 3, the eye driving means 14, a mouth driving means 16, and the body driving means 15 are respectively selectively operated, so that the stuffed toy 1 suitably performs head motion, blinking, opening and closing of the mouth, or gesturing. As the eye driving means 14, the mouth driving means 16, and the body driving means 15, in addition to the motor, solenoid, cylinder, shape memory alloy, or electromagnet, the crank movement or gear movement can be used.

The nodding timing is important in determining the respective motion timings in the pseudo-listener control flow, and except for the opening and closing of the mouth and the motions of the respective portions of the body based on the amplitude of the voice, the blinking or gesturing is based on the nodding timing (blinking) or uses the same algorithm (gesturing). Specifically, it becomes as follows: First, from the voice from the voice input-output portion 5, the nodding timing as the pseudo-listener is presumed in the pseudo-person control portion 6 (nodding presumption). In this example, the MA model is used as the model to predict the nodding by linear combination of voice. In this nodding presumption, on the basis of the voice changing with time, the prediction value of nodding changing every hour is calculated in real time. Here, the prediction value of nodding is compared with a predetermined nodding threshold, and the case where the prediction value of nodding exceeds the nodding threshold is made the nodding timing. The head driving means 13 is made to operate at the nodding timing, and the nodding is executed. With respect to the blinking, the nodding timing obtained first is made the first blinking timing, the first blinking timing (=first nodding timing) is made a start point, and the blinking timing exponentially distributed with the passage of time is obtained. Since such blinking in relation to the nodding looks to be a natural listener's reaction in conversation, an atmosphere where a person talking to the stuffed toy 1 can talk with ease is formed (entrainment occurs). With respect to the gesturing, a plurality of motion patterns of combinations of movable parts (for example, arm, body, leg) of the respective portions of the stuffed toy 1 are prepared in advance, and a motion pattern is selected among these plurality of motion patterns at each gesturing timing and is executed. Particularly, when the arm is swung in accordance with the magnitude of voice, accents are given to the gesturing, which is preferable. Such selection of the motion patterns realizes the natural gesturing, not mechanical repetition. In addition, it is also conceivable that the movable parts are selected and they are individually or cooperatively actuated, or the gesturing is controlled by assessing the significance from language analysis of the voice signal.

The above description is the same in the case where the pseudo-person control portion 6 functions as a talker control portion. However, since it is conceivable that the action of the stuffed toy 1 becomes different according to whether it is a pseudo-listener or a pseudo-talker, a difference is given to the prediction model to derive the prediction value of nodding or prediction value of head motion (MA model relating voice to nodding is used in the pseudo-listener, MA model relating voice to head motion is used in the pseudo-listener), or difference numerical values are used for the gesturing threshold between the pseudo-listener and the pseudo-talker. In the case where the cost as a device is considered, it is not necessary to individually construct the listener control portion and the talker control portion, rather, since respective control flows are similar, it is appropriate that they are made the pseudo-person control portion 6 of one body in hardware, and the control flows are internally chosen.

An example of FIG. 4 is an embodied voice responsive toy in which an animation 2 similar to the stuffed toy is displayed on a display 17 as a pseudo-listener or a pseudo-talker. A different point from the example of FIG. 1 is that the action of the animation 2 is not determined from voice, but a pseudo-person control portion 6 is actuated using a voice synthesized from text data. For example, a data input-output portion 19, a data recording or reproducing portion 20, a data conversion portion 21, and a pseudo-person control portion 6 are constructed in a computer 18 in hardware or software. The data are inputted to the data input-output 19 by using a keyboard 12, a voice is synthesized in the data conversion portion 21, and the voice is sent from the speaker 4 through the voice input-output portion 5. The keyboard 12 also serves to change the listener control and the talker control of the pseudo-person control portion 6. In the case of this example, the data are stored in the recording medium 9 from the data recording or reproducing portion 20, or the synthesized voice is stored in the recording medium 9 from the voice recording or reproducing portion 7. When the voice is sent from the speaker 4, it is preferable that the data input-output portion 19 displays the data to be reproduced as a balloon 22 at the side of the animation 2.

Figure 5:
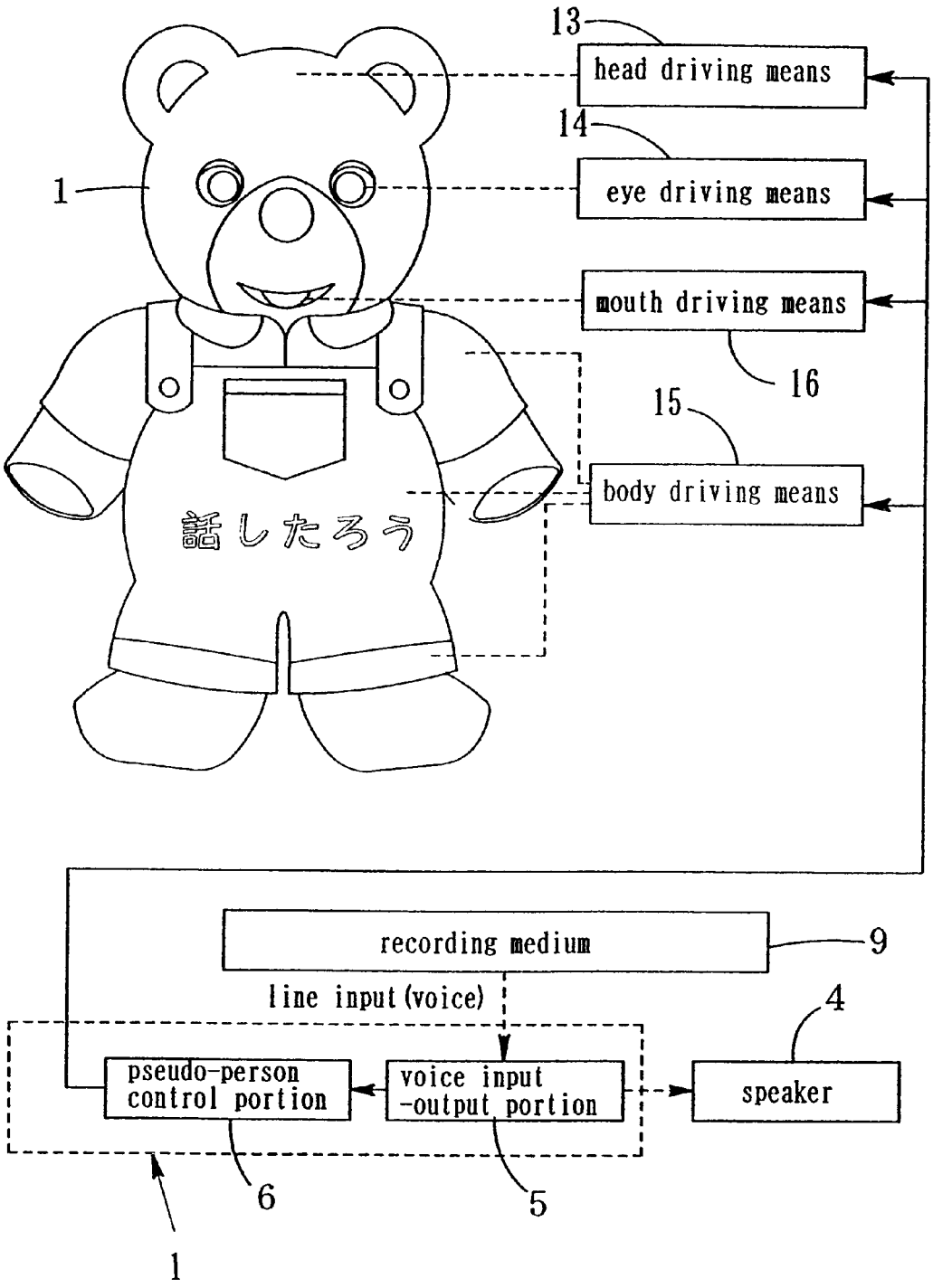
FIG. 5 is a structural view of an embodied voice responsive toy (model name "Hanashi-Taro" ("Hanashi" is Speaking a message, "Taro" is a boy's name in Japan)) as an applied example.

As a specific applied example, an embodied voice responsive toy as shown in FIG. 5 can be exemplified. In this example, as a recording medium 9, a commercially available music CD or game software (voice data or text data capable of being synthesized is made an object) is used, a signal obtained by, for example, reproducing the music CD is sent to a voice input-output portion 5 through line input (in the case where data is transmitted, the voice obtained after passing through the data input-output portion 19 and the data conversion portion 21 is inputted to the voice input-output portion 5, see FIG. 4), music is sent from the speaker 4, and the stuffed toy 1 as the pseudo-talker is moved. Since an object is to form the movement of the stuffed toy 1, differently from the example of FIG. 1, the pseudo-person control portion 6 uses a talker control flow suitably driving the head driving means 13 as well. Conventionally, although there are many dolls and toys moving their bodies in accordance with music CD, if the present invention is applied, since the stuffed toy causes the entrainment, it is visually easy to empathize, and the toy moves so that appreciation of music or game becomes more enjoyable. In this case, there is also an effect to visually enjoy the movement itself of the stuffed toy 1. Similarly, it is also conceivable that voice of a telephone or television is line inputted, and the telephone with voice only is visualized and is enjoyed, or the movement of the stuffed toy 1 responding to the television is enjoyed.

The present invention provides a toy which uses a voice and causes empathy more easily. Concretely speaking, in the case where a person becomes a talker, a pseudo-listener shares the rhythm of conversion with the talker and causes entrainment, so that empathy for the conversion is made possible. In the case where it is regarded as a message device for recording voice (or data), words of a talker with more feeling can be recorded on the recording medium. Further, in the case where a person becomes a listener, a pseudo-talker indicates an action (communication motion) suitable for a reproduced voice, so that the rhythm of conversion to the listener is shared, and more smooth or intimate mind communication is realized by using the entrainment.

In the case of an embodied voice responsive toy as a message device, it is also possible to attempt mind communication by an exchange of only a recording medium. In this case, although it is preferable if both a transmitter and a destination have the embodied voice responsive toys of the present invention, even in the case where, for example, only one of them has the embodied voice responsive toy, it is possible to record the voice to be transmitted with feeling at the time of recording, or it is possible express the transmitted voice with feeling at the time of reproduction. This means that even in the case where the recording medium is a cassette tape, and one of them uses a cassette tape recorder, if the other has the embodied voice responsive toy of the present invention, the effect of the present invention can be enjoyed.

In this way, the present invention provides an embodied voice responsive toy which can cause empathy more easily.

Thus, also to a conventional toy using voice, application is conceivable as described above. The simplest applied example is, for example, a robot or animation making a motion in accordance with reproduction of a music CD or voice data of a game. Further, an applied example is a robot or animation connected to a telephone and giving response to a talker or moving in accordance with the voice of the other party. In such applied examples, by combination of motions of respective body portions with nodding or head motion as the main motion, they are more natural and more acceptable for a person, and unprecedented empathy can be realized.

We claim:

1. An embodied voice responsive toy comprising:

a voice input-output portion;

a voice responsive pseudo-person; and a pseudo-person control portion;

the voice input-output portion serves to input voice from the outside or output the pseudo-person control portion determines actions of the voice responsive pseudo-person from the voice passing through the voice input-output portion and actuates the voice responsive pseudo-person; and wherein the action of the voice responsive pseudo-person as the listener is made of a selective combination of nodding of a head, blinking of eyes, and gesturing of a body, and the nodding is executed at a nodding timing when a prediction value of nodding presumed from ON/OFF of the voice exceeds a nodding threshold.

2. An embodied voice responsive toy according to claim 1, wherein the voice responsive pseudo-person is a shared robot of a listener and a talker, the pseudo-person control portion is listener and talker control portions, the shared robot makes an action of nodding of a head, head motion, opening and closing of a mouth, blinking of an eye, or gesturing of a body in response to the voice, the listener control portion determines the action of the shared robot as a listener on the basis of the voice passing through the voice input-output portion and activates the shared robot, and the talker control portion determines the action of the shared robot as a talker on the basis of the voice passing through the voice input-output portion and activates the shared robot.

3. The embodied voice responsive toy according to claim 1, wherein said voice responsive pseudo-person is a listener display portion displaying a listener, said pseudo-person control portion is a listener control portion, the listener display portion displays a pseudo-listener, which makes head motion, opening and closing of a mouth, blinking of eyes, or gesturing of a body in response to the voice, on the listener display portion, and the listener control portion determines the action of the pseudo-listener on the basis of the voice passing through the voice input-output portion and moves the pseudo-listener displayed on the listener display portion.

4. The embodied voice responsive toy according to claim 1, wherein said blinking is executed at a blinking timing which is exponentially distributed with the passage of time from the nodding timing as a starting point.

5. The embodied voice responsive toy according to claim 1, wherein said gesturing of the body is executed at a gesturing timing when a prediction value of nodding presumed from ON/OFF of the voice exceeds a gesturing threshold.

6. The embodied voice responsive toy according to claim 1, wherein said voice responsive pseudo-person is a listener robot, the pseudo-person control portion is a listener control portion, the listener robot makes actions of nodding of a head, opening and closing of a mouth, blinking of eyes, or gesturing of a body in response to the voice, and the listener control portion determines the action of the listener robot on the basis of the voice passing through the voice input-output portion and activates the listener robot.

7. The embodied voice responsive toy according to claim 1, wherein said voice responsive pseudo-person is a shared display portion displaying a listener and a talker, said pseudo-person control portion is listener and talker control portions, the shared display portion displays a pseudo-talker and a pseudo-listener individually, which make actions of nodding of a head, head motion, opening and closing of a mouth, blinking of eyes, or gesturing of a body in response to a voice signal, in the same space, the listener control portion determines the action of the pseudo-listener on the basis of the voice passing through the voice input-output portion and moves the pseudo-listener displayed on the shared display portion, and the talker control portion determines the action of the pseudo-talker on the basis of the voice passing through the voice input-output portion and moves the pseudo-talker displayed on the shared display portion.

8. An embodied voice responsive toy comprising:

a voice input-output portion;

a voice responsive pseudo-person; and a pseudo-person control portion, the voice input-output portion serves to input voice from the outside or output voice to the outside, and the pseudo-person control portion determines actions of the voice responsive pseudo-person from the voice passing through the voice input-output portion and actuates the voice responsive pseudo-person; and wherein the action of the voice responsive pseudo-person as the talker is made of a selective combination of head motion, opening and closing of a mouth, blinking of eyes, or gesturing of a body, and the gesturing of the body is executed at a gesturing timing when a prediction value of head motion or a prediction value of gesturing presumed from ON/OFF of the voice exceeds a gesturing threshold.

9. The embodied voice responsive toy according to claim 8, wherein a blinking is executed at a blinking timing when a prediction value of nodding presumed from ON/OFF of the voice exceeds a blinking threshold.

10. The embodied voice responsive toy according to claim 8, wherein a gesturing of the body is executed at a gesturing timing when a prediction value of nodding presumed from ON/OFF of the voice exceeds a gesturing threshold.

11. The embodied voice responsive toy according to claim 8, wherein said voice responsive pseudo-person is a talker robot, said pseudo-person control portion is a talker control portion, the talker robot makes head motion, opening and closing of a mouth, blinking of eyes, or gesturing of a body in response to the voice, and the talker control portion determines the action of the talker robot on the basis of the voice passing through the voice input-output portion and activates the talker robot.

12. The embodied voice responsive toy according to claim 8, wherein said voice responsive pseudo-person is a shared robot of a listener and a talker, said pseudo-person control portion is listener and talker control portions, the shared robot makes actions of nodding of a head, head motion, opening and closing of a mouth, blinking of eyes, or gesturing of a body in response to the voice, the listener control portion determines the action of the shared robot as a listener on the basis of the voice passing through the voice input-output portion and activates the shared robot, and the talker control portion determines the action of the shared robot as a talker on the basis of the voice passing through the voice input-output portion and activates the shared robot.

13. The embodied voice responsive toy according to claim 8, wherein the voice responsive pseudo-person is a talker display portion displaying a talker, the pseudo-person control portion is a talker control portion, the talker display portion displays a pseudo-talker, which makes actions of nodding of a head, opening and closing of a mouth, blinking of eyes, or gesturing of a body in response to a voice signal, on the talker display portion, and the talker control portion determines the action of the pseudo-talker on the basis of the voice passing through the voice input-output portion and moves the pseudo-talker displayed on the talker display portion.

14. The embodied voice responsive toy according to claim 8, wherein said voice responsive pseudo-person is a shared display portion displaying a listener and a talker, said pseudo-person control portion is listener and talker control portions, the shared display portion displays a pseudo-talker and a pseudo-listener individually, which make actions of nodding of a head, head motion, opening and closing of a mouth, blinking of eyes, or gesturing of a body in response to a voice signal, in the same space, the listener control portion determines the action of the pseudo-listener on the basis of the voice passing through the voice input-output portion and moves the pseudo-listener displayed on the shared display portion, and the talker control portion determines the action of the pseudo-talker on the basis of the voice passing through the voice input-output portion and moves the pseudo-talker displayed on the shared display portion.

15. The embodied voice responsive toy according to claim 1 or 8, further comprising a voice recording or reproducing portion in addition to the voice input-output portion.

16. The embodied voice responsive toy according to claims 1 or 8, further comprising a data input-output portion and a data conversion portion in addition to the voice input-output portion, wherein the data input-output portion serves to input data other than the voice from the outside or output data other than the voice to the outside, and the data conversion portion performs mutual conversion of the data other than the voice and the voice to transfer the voice to the voice input-output portion.

17. The embodied voice responsive toy according to claim 16, further comprising a data recording or reproducing portion in addition to the data input-output portion.

* * * * *